US006520656B2

(12) United States Patent
Park et al.

(10) Patent No.: US 6,520,656 B2
(45) Date of Patent: Feb. 18, 2003

(54) ORNAMENT FOR BODY ORNAMENTATION OR DECORATION USING CHEMICAL LIGHT

(75) Inventors: Koon Ha Park, Taejon (KR); Kap Soo Oh, Jeonju (KR)

(73) Assignee: Yong Rae Kim, Yongin-Si (KR)

( * ) Notice: Subject to any disclaimer, the term of this patent is extended or adjusted under 35 U.S.C. 154(b) by 0 days.

(21) Appl. No.: 09/855,783

(22) Filed: May 16, 2001

(65) Prior Publication Data

US 2002/0176244 A1 Nov. 28, 2002

(51) Int. Cl.[7] ..... F21K 2/00

(52) U.S. Cl. ..... 362/34; 362/84; 362/806; 362/808

(58) Field of Search ..... 362/34, 806, 807, 362/808, 809, 84, 101, 318, 812

(56) References Cited

U.S. PATENT DOCUMENTS 5,043,851 A * 8/1991 Kaplan ..... 362/34
5,083,242 A * 1/1992 Piotrowski ..... 362/253
5,557,869 A * 9/1996 Douglas ..... 362/34
5,809,678 A * 9/1998 Douglas ..... 362/34
6,106,129 A * 8/2000 Cranor et al. ..... 250/462.1

* cited by examiner

*Primary Examiner*—Sandra O'Shea
*Assistant Examiner*—John Amarantides
(74) *Attorney, Agent, or Firm*—Jacobson Holman PLLC

(57) ABSTRACT

Disclosed is an ornament for body ornamentation or decoration using a chemical light, which is capable of emitting light even in the daytime, thereby providing an improved aesthetic effect and an enhanced attraction effect. The ornament includes a cylindrical chemical light serving as a light emitting source, a molded body made of a transparent material and provided with irregularities at an outer surface thereof, an insertion hole formed at a central portion of the molded body and opened at one end to receive the chemical light, the insertion hole having a desired shape, and a connecting ring formed at the molded body near the opened end of the insertion hole while being integral with the molded body, the connecting ring serving to allow the molded body to be connected to an object, whereby a shadow is expressed by virtue of the irregularities when the chemical light received in the insertion hole emits light.

5 Claims, 5 Drawing Sheets

S : source
P : image point
P': virtual source

ORNAMENT FOR BODY ORNAMENTATION OR DECORATION USING CHEMICAL LIGHT

BACKGROUND OF THE INVENTION

1. Field of the Invention

The present invention relates to an ornament for body ornamentation or decoration using a chemical light, and more particularly to an ornament for body ornamentation or decoration using a chemical light, in which an insertion hole for receiving a chemical light adapted to emit light in accordance with a chemical reaction is formed, to have a desired optical structure, at a molded body made of a transparent material and formed with irregularities of a desired shape at a front portion thereof, thereby being capable of maximizing the brightness of light transmitting through the front portion of the molded body while expressing a shadow of light by virtue of the irregularities.

2. Description of the Related Art

Referring to FIG. 1, a chemical light is illustrated. As shown in FIG. 1, the chemical light, which is denoted by the reference numeral 1, includes a glass container 3 contained with a first chemical material 4-1, a vinyl container 2 for receiving the glass container 3 therein, and a second chemical material 4-2 interposed between the glass container 3 and the vinyl container 2. When the glass container 3 is broken by an external force applied thereto, the first chemical material comes into contact with the second chemical material, so that they react with each other, thereby producing light. The emission of light may be sustained for 5 to 24 hours. Such a chemical light product is widely used for fishing products, such as fishing lures, for attracting fishes at night.

SUMMARY OF THE INVENTION

An object of the invention is to provide an ornament for body ornamentation or decoration using a chemical light, in which an insertion hole for receiving a conventional chemical light adapted to emit light in accordance with a chemical reaction is formed, to have a desired optical structure, at a molded body made of a transparent material and formed with irregularities of a desired shape at a front portion thereof, thereby being capable of maximizing the brightness of light transmitting through the front portion of the molded body while expressing a shadow of light by virtue of the irregularities.

In accordance with the present invention, this object is accomplished by providing an ornament for body ornamentation or decoration comprising: a cylindrical chemical light serving as a light emitting source; a molded body made of a transparent material and provided with irregularities at an outer surface thereof; an insertion hole formed at a central portion of the molded body and opened at one end to receive the chemical light, the insertion hole having a desired shape; and a connecting ring formed at the molded body near the opened end of the insertion hole while being integral with the molded body, the connecting ring serving to allow the molded body to be connected to an object; whereby a shadow is expressed by virtue of the irregularities when the chemical light received in the insertion hole emits light.

Preferably, the insertion hole has a triangular prism shape having a front surface with two points of inflection and a rear surface with a point of inflection, the front surface having an arc shape connecting the two points of inflection while being concave toward the rear surface. The insertion hole has an optical structure capable of maximizing the amount of light transmitting through the front portion of the molded body.

BRIEF DESCRIPTION OF THE DRAWINGS

The above objects, and other features and advantages of the present invention will become more apparent after a reading of the following detailed description when taken in conjunction with the drawings, in which.

DESCRIPTION OF THE PREFERRED EMBODIMENTS

Now, the present invention will be described in detail with reference to the annexed drawings.

Figure 2:
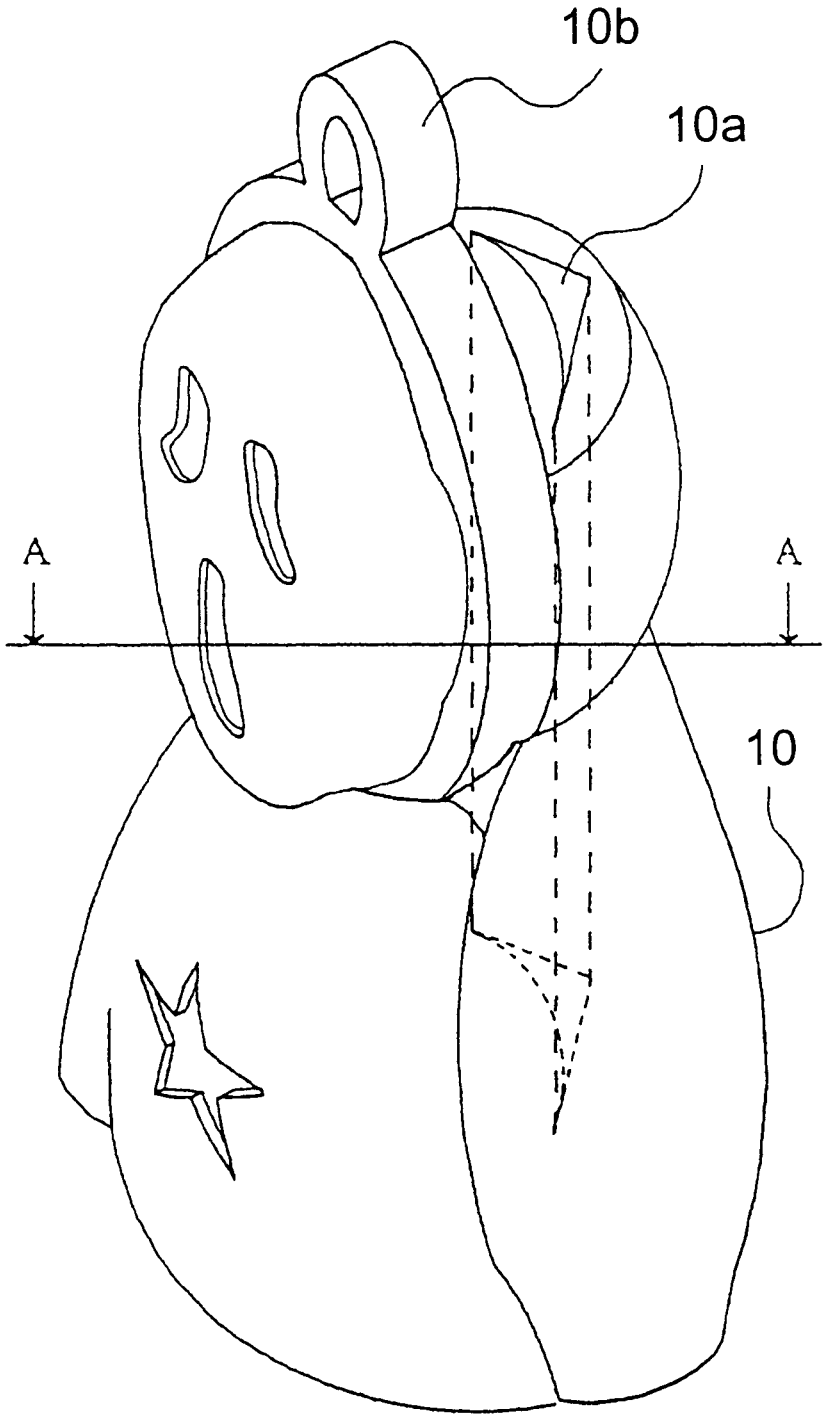
FIG. 2 is a perspective view illustrating an ornament for body ornamentation using a chemical light in accordance with an embodiment of the present invention.
Figure 3:
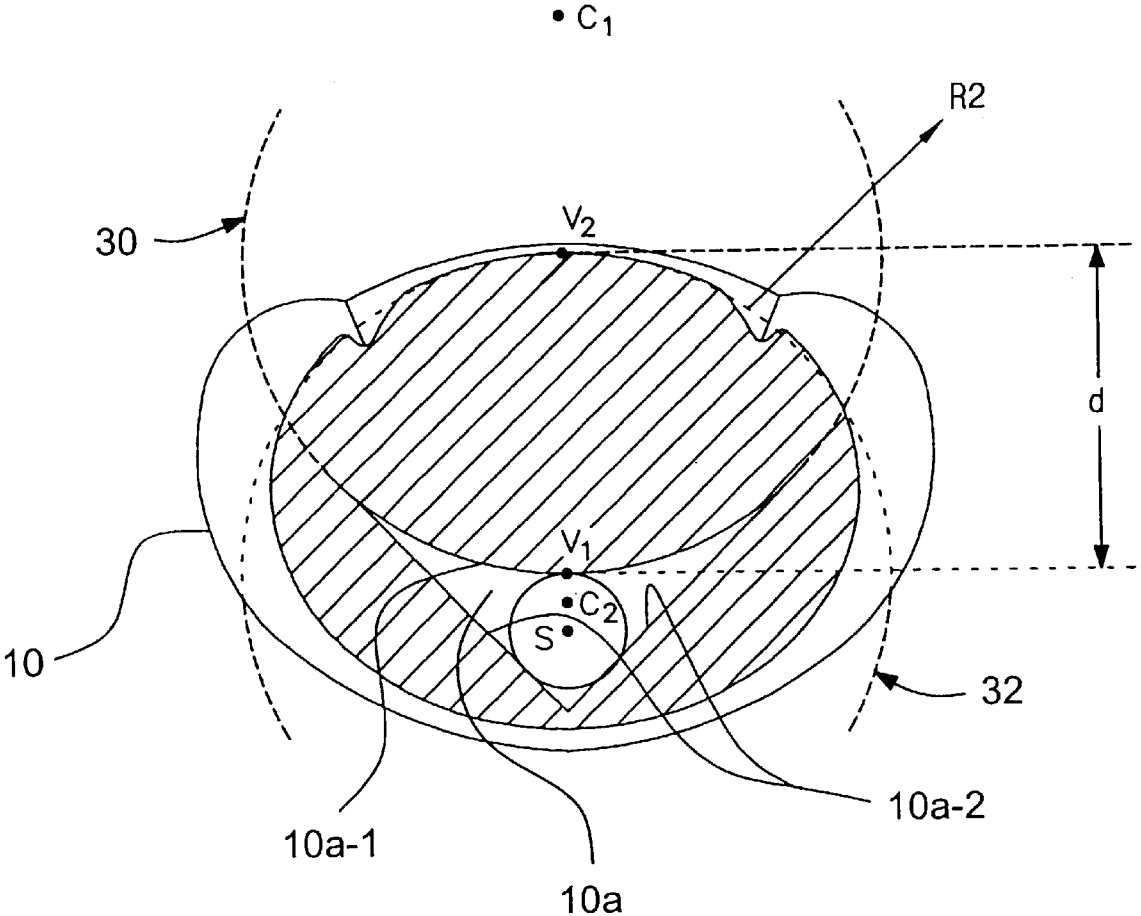
FIG. 3 is a cross-sectional view taken along the line A–A' of FIG. 2.

FIG. 2 is a perspective view illustrating an ornament for body ornamentation according to the present invention. FIG. 3 is a cross-sectional view taken along the line A–A' of FIG. 2.

The ornament according to the present invention includes a molded body made of one selected from diverse transparent materials such as glass, acryl, Formica, and polypropylene. Although the ornament of the present invention is described in conjunction with embodiments illustrated in the drawings, it is not limited to those embodiments. Where the molded ornament is used for body ornamentation, it may have diverse shapes such as necklaces, ornamental hairpins, hairpins, and earrings. On the other hand, where the molded ornament is used for decoration, it may have diverse shapes such as dolls, clocks, and decorations of show windows.

Figure 1:
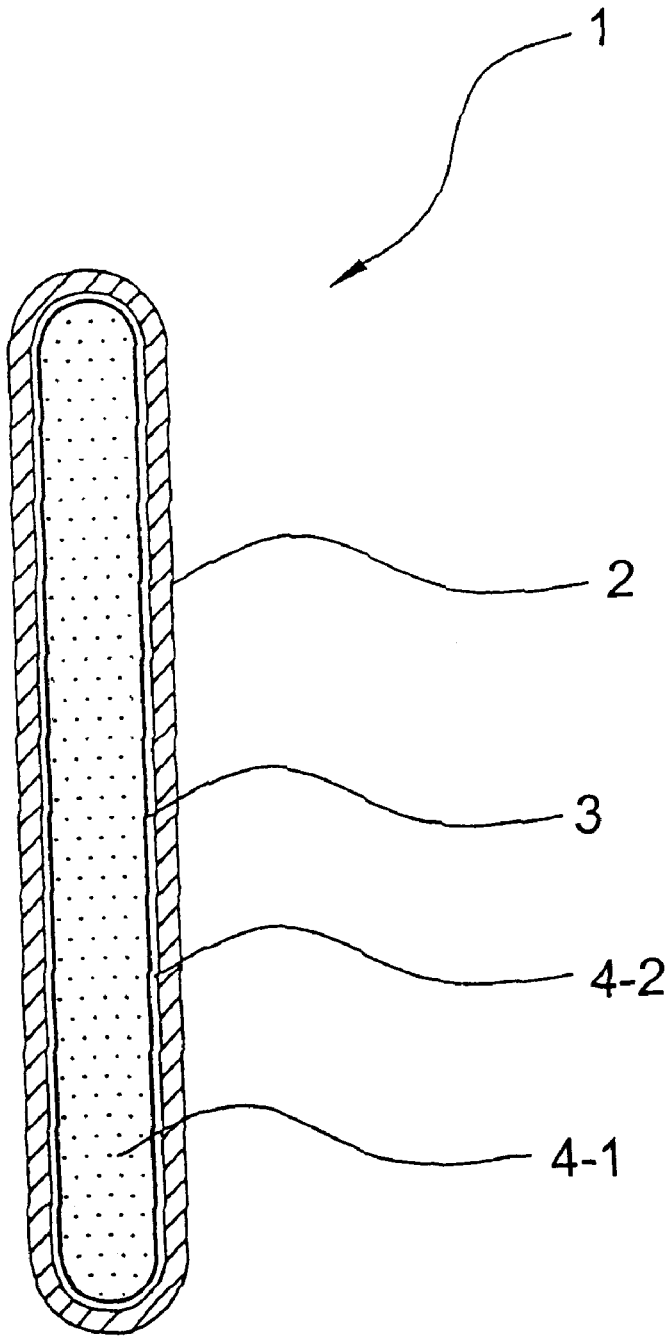
FIG. 1 (PRIOR ART)
FIG. 1 is a sectional view illustrating a chemical light.

As shown in FIGS. 2 and 3, the ornament of the present invention, which is denoted by the reference numeral 10, is shaped to receive a chemical light such as the chemical light 1 shown in FIG. 1 so that it emits light. This ornament 10 is made of a transparent material and has irregularities of a desired shape or pattern at the outer surface thereof, in particular, the front surface thereof. In order to receive the chemical light 1, the ornament 10 is provided at the central portion thereof with an insertion hole 10*a* having a desired shape. The insertion hole 10*a* is opened at one end thereof. The ornament 10 is also provided at the upper end thereof with a connecting ring 10*b* adapted to allow the ornament 10 to be connected to a necklace.

Figure 5:
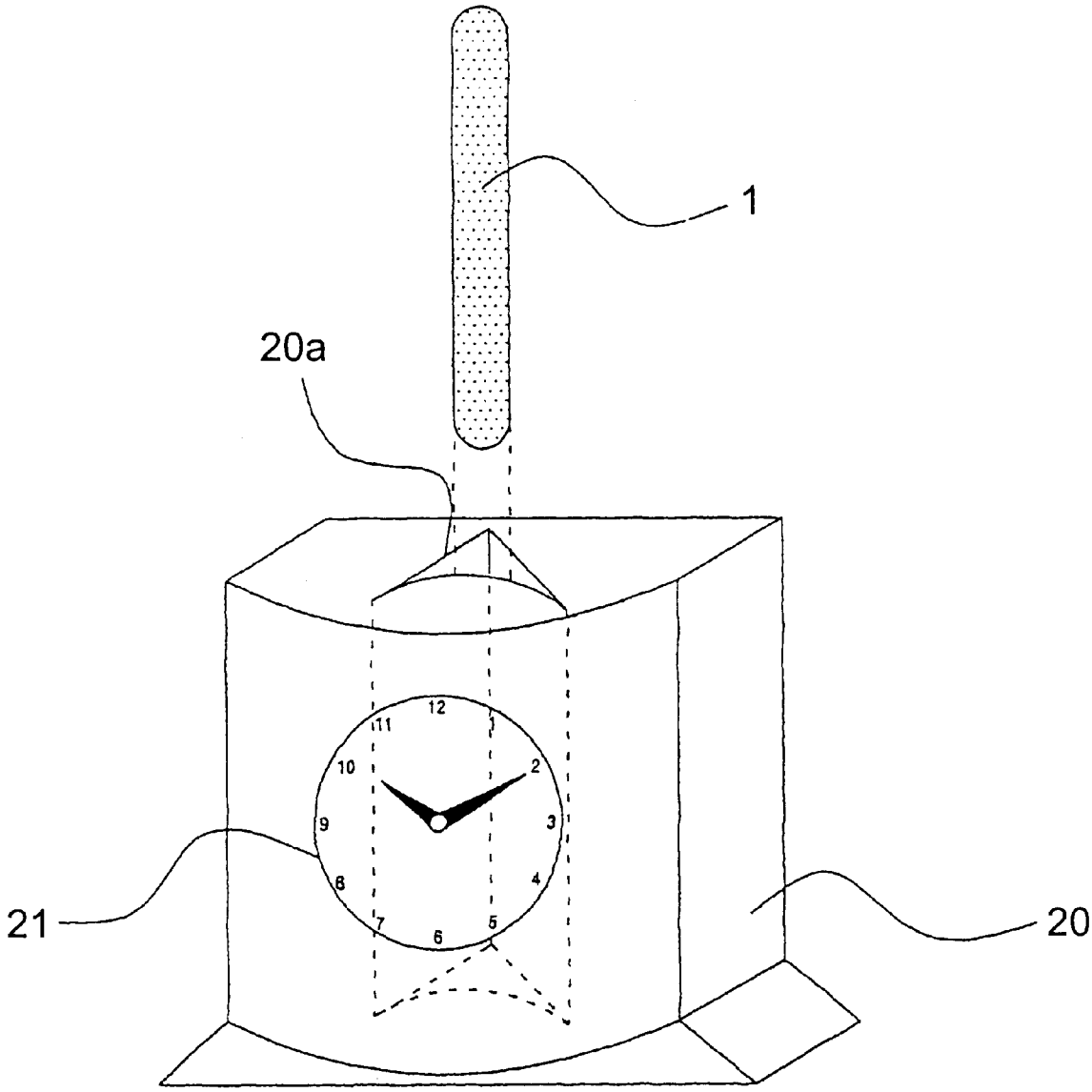
FIG. 5 is a perspective view illustrating an ornament for decoration using a chemical light in accordance with another embodiment of the present invention.

Although the ornament 10 illustrated in FIGS. 2 and 3 has the form of a molded product for body ornamentation, it may have the form of a molded product for decoration. Referring to FIG. 5, an ornament is illustrated which has the form of a clock-held molded product.

As shown in FIG. 5, the ornament, which is denoted by the reference numeral 20, carries a clock 21 at its front portion. At the rear of the clock 21, the ornament 20 is formed with an insertion hole 20*a*.

The insertion hole 10*a* of the ornament 10 may have a circular cross-section identical to that of the chemical light 1. In the illustrated case, the insertion hole 10*a* has a cross-sectional structure capable of allowing an increased amount of light to be transmitted through the front portion of the ornament 10. That is, the insertion hole 10*a* has a triangular prizm structure having a front surface 10*a*-1 with two points of inflection and a rear surface 10*a*-2 with a point of inflection. The front surface 10*a*-1 has an arc shape connecting the two points of inflection while being concave toward the rear surface 10*a*-2.

The shape of the insertion hole 10*a* is determined using an optical principle to allow an increased amount of light to be transmitted through the front portion of the ornament 10. The optical principle will now be described with reference to an optical concept diagram illustrated in FIG. 4.

The geometry of a light path disclosed in page 107, "Optics" written by Mr. Eujene Hecht & Mr. Alfred Zajac and published by Addison-Wesley in 1979 can be expressed by the following Expression 1:

$$\frac{n_m}{S_{oI}} + \frac{n_m}{S_{i2}} = (n_e - n_m)\left(\frac{1}{R_1} - \frac{1}{R_2}\right) + n_e\frac{d}{(S_{iI} - d)S_{iI}} \quad \text{[Expression 1]}$$

$$\text{provided, } n_m = 1 \quad n_e = 1$$

$$S_{iI} < 0, \quad R_2 < 0, \quad \text{and} \quad S_{i2} \approx \infty$$

Figure 4:
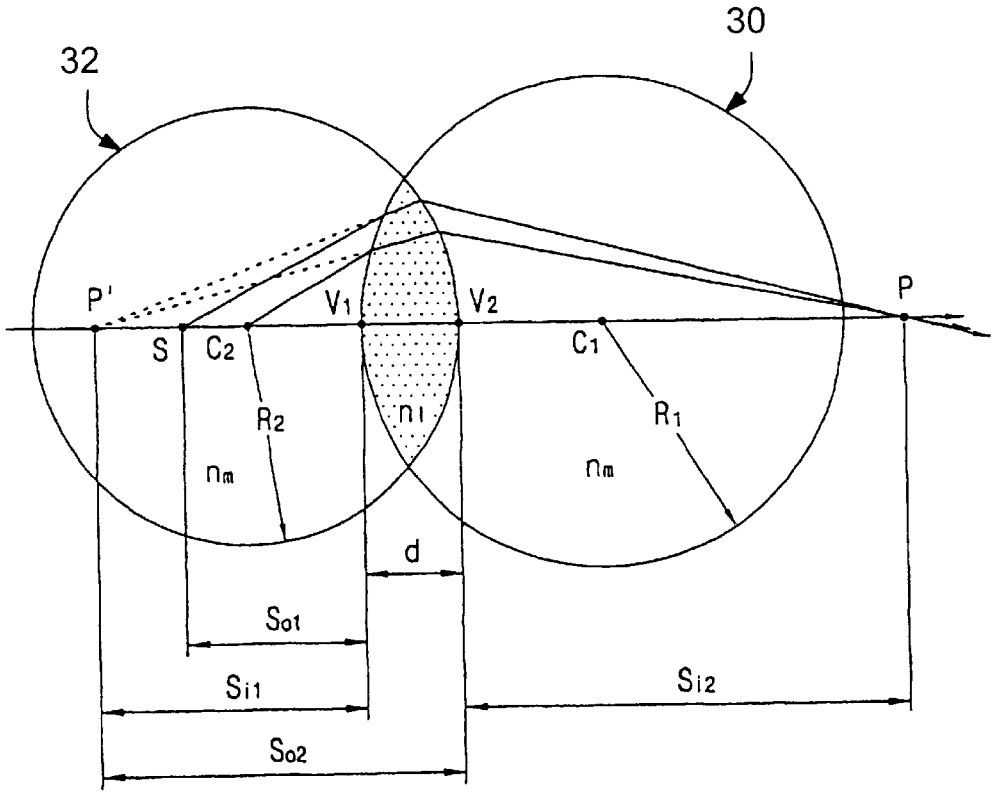
FIG. 4 is an optical concept diagram illustrating the formation of an insertion hole in an ornament for body ornamentation using a chemical light in accordance with the present invention.

In Expression 1, $n_m$, represents the refractive index of air, $n_e$ represents the refractive index of the material used, $S_{i1}$ and $S_{i2}$ represents distances used to explain Expression 1 illustrated in FIG. 4, and $R_2$ represents the radius of the left circle in FIG. 4, respectively. In this Expression 1, diffraction effects of light are neglected because the ornament of the present invention is not an optical product having a high precision. Although the ornament of the present invention has a shape slightly different from a cylindrical shape, it is assumed to have a geometrical structure corresponding to a cylindrical shape. Under this assumption, the above mentioned Expression 1 may be simplified into the following Expression 2:

$$\frac{1}{S_{oI}} = (n_1 - 1)\left(\frac{1}{R_1} - \frac{1}{R_2}\right) + \frac{n_1 d}{(S_{iI} - d)S_{iI}} \quad \text{[Expression 2]}$$

In page 106, the above mentioned article, an expression representing a correlation of the optical path with refractive indices is disclosed. This expression corresponds the following Expression 3:

$$\frac{1}{S_{oI}} + \frac{n_1}{S_{iI}} = \frac{n_1 - 1}{R_1} \quad \text{[Expression 3]}$$

Based on Expressions 2 and 3, it is possible to derive $S_{i1}$, as expressed by the following Expression 4:

$$S_{iI} = \frac{n_1 S_{oI} R_1}{(n_1 - 1)S_{oI} - R_1} \quad \text{[Expression 4]}$$

When the value of $S_{i1}$, derived from Expression 4 is applied to Expression 2, the following Expression 5 can be derived:

$$\{(n_1-1)(n_1S_{o1}+d)+n_1R_2\}R_1^{2-}(n_1-1)S_{o1}\{n_1R_2+(n_1-1)d\}R_1=0 \quad \text{[Expression 5]}$$

When Expression 5 is arranged with reference to $R_1$, the following Expression 6 can be derived:

$$R_1 = \frac{(n_1 - 1)S_{oI}\{n_1 R_2 + (n_1 - 1)d\}}{(n_1 - 1)(n_1 S_{oI} + d) + n_1 R_2} \quad \text{[Expression 6]}$$

Using Expression 6, a desired insertion hole can be formed at the molded body. For example, where the molded body is made of a glass material, the insertion hole of the molded body can be formed by applying, to Expression 6, the refractive index of glass, $n_1$, the distance d from the peripheral portion of a circle, defined by the molded body at the front portion of the molded body, to an arc defined by the front surface of the insertion hole to be formed, the distance $S_{o1}$ from the arc to the center of the chemical light, that is, a light source, and the radius of the circle, $R_2$, thereby deriving the radius of curvature of the arc, $R_1$.

With reference to FIG. 4, $S_{o2}$ represents the distance from the virtual source P' to $V_2$, with $V_1$ and $V_2$ representing points of intersection between center axes $C_1$, $C_2$ of the two spheres, generally designated by the reference numerals 30, 32, respectively, and their peripheral surfaces.

That is, the shape of the insertion hole to be formed at the molded body is determined, based on the radius of curvature of the arc, $R_1$, calculated on the basis of the refractive index of the molded body, $n_1$, the thickness d of the molded body at the front of the insertion hole, that is, the thickness of a desired irregularity portion of the molded body, the distance $S_{o1}$ to the center of the light source S, and the radius $R_2$ of the circle 32.

By virtue of the insertion hole 10*a* having the above mentioned shape, the ornament 10 made of a transparent material according to the present invention is allowed to transmit an increased amount of light emitted from the chemical light 1 received in the insertion hole 10*a* through the front portion of the ornament to the image point P. Accordingly, the ornament 10 of the present invention provides an improved aesthetic effect and an enhanced attraction effect.

Light beams emitted from the chemical light 1 received in the insertion hole 10*a* of the ornament 10 transmit the arc-shaped front surface 10*a*-1 of the insertion hole 10*a*, and then passes through the front portion of the ornament 10. Since the front portion of the ornament 10 defined between the front surface 10*a*-1 of the insertion hole 10*a* and the irregularity surface of the ornament 10 has a shape similar to a convex lens, it serves to focus the light beams incident thereto. Thus, the light from the chemical light 1 is emitted through the ornament 10 in a focused state.

By virtue of such an effect, the ornament 10 looks like a light emitting source. Furthermore, a certain shadow is expressed by virtue of the shape of the irregularity portion of the ornament 10. As a result, an improved aesthetic effect and an enhanced attraction effect are provided.

As apparent from the above description, the present invention provides an ornament made of a transparent material and formed with an insertion hole adapted to receive a chemical light, so that it can emit light by virtue of a light emitting function of the chemical light, thereby providing an improved aesthetic effect and an enhanced attraction effect.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An ornament for body ornamentation or decoration comprising:

a cylindrical chemical light serving as a light emitting source;

a molded body made of a transparent material having a refractive index and provided with irregularities at an outer surface thereof;

an insertion hole formed at a central portion of the molded body and opened at one end to receive the chemical light, the insertion hole having a desired shape determined using an optical principle that applies the refractive index and a radius of curvature of said molded body to maximize an amount of light transmitted through a front portion of said molded body; and a connecting ring formed at the molded body near the opened end of the insertion hole while being integral with the molded body, the connecting ring serving to allow the molded body to be connected to an object;

whereby a shadow is expressed by virtue of the irregularities when the chemical light received in the insertion hole emits light.

2. The ornament according to claim 1, wherein the insertion hole has a triangular prism shape having a front surface with two points of inflection and a rear surface with a point of inflection, the front surface having an arc shape connecting the two points of inflection while being concave toward the rear surface, a distance between said front surface and a front portion of said molded body being determined using said optical principle.

3. The ornament according to claim 2, wherein the front surface of the insertion hole has a radius of curvature determined based on said refractive index of the molded body, a thickness of a portion of the molded body where the irregularities are formed, a distance from the front surface to a center of the light source, and a radius of curvature of the molded body.

4. An ornament for body ornamentation or decoration comprising:

a cylindrical chemical light serving as a light emitting source;

a molded body made of a transparent material having a refractive index and provided with irregularities at a front portion of an outer surface thereof;

an insertion hole formed at a central portion of the molded body and opened at one end to receive the chemical light, the insertion hole having a triangular prism shape with a front surface having two points of inflection and a rear surface having one point of inflection, the front surface having an arc shape connecting the two points of inflection while being concave toward the rear surface, a distance between said front surface and said front portion of said molded body being determined using an optical principle that maximizes an amount of light transmitted through said front portion; and a connecting ring formed at the molded body near the opened end of the insertion hole while being integral with the molded body, the connecting ring serving to allow the molded body to be connected to an object;

whereby a shadow is expressed on said front portion by virtue of the irregularities when the chemical light received in the insertion hole emits light.

5. The ornament according to claim 4, wherein the front surface of the insertion hole has a radius of curvature determined based on said refractive index of the molded body, a thickness of said front portion of the molded body, a distance from the front surface to a center of the light source, and a radius of curvature of the molded body.

* * * * *